US009623543B2

(12) United States Patent
Chkautovich

(10) Patent No.: US 9,623,543 B2
(45) Date of Patent: Apr. 18, 2017

(54) FLANGE TIGHTENING TOOL

(71) Applicant: Milomir Chkautovich, Columbia, IL (US)

(72) Inventor: Milomir Chkautovich, Columbia, IL (US)

( * ) Notice: Subject to any disclaimer, the term of this patent is extended or adjusted under 35 U.S.C. 154(b) by 254 days.

(21) Appl. No.: 14/311,055

(22) Filed: Jun. 20, 2014

(65) Prior Publication Data

US 2014/0373687 A1 Dec. 25, 2014

Related U.S. Application Data

(60) Provisional application No. 61/837,749, filed on Jun. 21, 2013.

(51) Int. Cl.

| | |
|---|---|
| ***B25B 13/56*** | (2006.01) |
| ***B25B 13/16*** | (2006.01) |
| ***B25B 13/50*** | (2006.01) |

(52) U.S. Cl.

CPC ..... *B25B 13/5058* (2013.01)

(58) Field of Classification Search

CPC . B25B 13/5058; B25B 13/5041; B25B 13/56; B25B 13/58; B25B 13/48; B25B 13/481; B25B 13/16; B25B 13/18; B25B 27/14

See application file for complete search history.

(56) References Cited

U.S. PATENT DOCUMENTS 767,403 A * 8/1904 Glover et al. ..... B25B 7/18 81/176.3
1,398,125 A * 11/1921 Carleton et al. .... B25B 13/5058 81/150
1,425,845 A * 8/1922 Foster ..... B25B 13/02 81/176.15
1,579,992 A * 4/1926 Altman ..... B25B 13/08 81/176.15
3,010,347 A * 11/1961 Kron ..... B25B 13/12 7/139
3,498,160 A * 3/1970 Brockway et al. ..... B25B 13/02 81/176.3

(Continued)

OTHER PUBLICATIONS

Finkelstein, Pipefitter turns idea into a simple, effective tool, The Labor Tribune, Nov. 7, 2013, p. 12-13, v. 77, n. 12, The Labor Tribune, St. Louis.

(Continued)

*Primary Examiner* — David B Thomas
(74) *Attorney, Agent, or Firm* — Charles McCloskey

(57) ABSTRACT

Flanges become stuck upon large pipes. This invention is a flange tightening tool in combination with a wrench, or other handled tool, having a fixed jaw integral with a handle and a movable jaw. The invention provides pins connected to each of the fixed jaw and the movable jaw. The pins extend mutually parallel and from the same side of both jaws. The pins generally have a round cylindrical shape with a diameter compatible to a flange aperture. The pins have a connection to the wrench utilizing a threaded tip that engages a cooperating threaded hole in each jaw. The pins are provided in various diameters, often in kit form. One pin may be longer than the other pins and both pins have left hand threading.

10 Claims, 7 Drawing Sheets

(56) References Cited

U.S. PATENT DOCUMENTS

| | | | | | |
|---|---|---|---|---|---|
| 4,227,429 | A * | 10/1980 | Bowers, Jr. | B25B 13/06 | 81/176.15 |
| 5,469,766 | A * | 11/1995 | Hodges | B25B 7/04 | 81/176.3 |
| 6,131,494 | A * | 10/2000 | Quenneville | B25B 13/48 | 81/125.1 |
| 6,443,515 | B1 * | 9/2002 | Wu | B25B 13/10 | 269/282 |
| 7,069,821 | B2 * | 7/2006 | Hwang | B25B 13/10 | 81/176.3 |
| 7,272,996 | B2 * | 9/2007 | Pontieri | B24B 45/003 | 81/176.15 |
| 8,490,522 | B1 * | 7/2013 | Bryan | B25B 13/02 | 29/244 |
| 9,095,963 | B2 * | 8/2015 | Huang | B25B 27/0035 | 81/487 |

OTHER PUBLICATIONS

McManus, Local 562 Member Creates New Tool for Pipefitters, UA Journal, Apr. 2014, p. 31, v. 116, n. 3, United Association of Journeymen & Apprentices of Plumbing, Annapolis.

* cited by examiner

FLANGE TIGHTENING TOOL

CROSS-REFERENCE TO RELATED APPLICATION

This non-provisional application claims priority to the pending provisional application 61/837,749 filed on Jun. 21, 2013 and all of which are owned by the same inventor.

BACKGROUND OF THE INVENTION

The flange tightening tool generally relates to wrenches and more specifically to a tool that places and tightens flanges upon the threaded ends of pipes, piping, stands, rails, fences, standards, and the like.

As America underwent the industrial revolution, various factories, warehouses, and other structures appeared. The structures served the people who worked in them and the cities around them. The structures housed various manufacturing, chemical, laboratory or petrochemical operations. These operations utilized piping of all description. The piping conveyed raw materials into the operations, carried prototype materials within the operations, and delivered finished materials from the operations. Select piping also served as fencing, handrails, and dividers in various settings. Piping also saw application out of doors for select manufacturing and chemical processes.

Piping though does not come in a finished assembly for manufacturing, chemical, laboratory or petrochemical operations. Rather, the piping must be assembled from standard and custom components into the desired assembly for the operation. Piping generally comes in hollow cylindrical form and with fittings of various shapes. Piping and related fittings also come in a host of diameters, wall thicknesses, materials, and the like. Generally piping requires a threaded end for connection to a fitting. Piping rarely connects directly to other piping unless welded. Piping and fitting manufacturers sometimes supply threaded ends, other times they do not. Various pipefitters carry the tools that incise and provide threading to ends of piping and fittings.

When connecting piping to piping or piping to a fitting, the plans and specifications for a project generally specify a flange type connection between two components. A flange is generally a cast disk of material with a hollow, threaded neck. The neck is generally centered upon the disk and perpendicular to the disk. Outwardly from the neck, a flange has a plurality of apertures. The neck typically has an internal diameter exceeding the outer diameter of related piping and internal threads, typically right hand. A pipefitter generally turns the neck upon a threaded end of piping until the flange stops rotating upon the end of piping. The pipefitter then aligns the apertures in the flange upon the piping with apertures on an adjacent flange of piping or a fitting.

DESCRIPTION OF THE PRIOR ART

Over the years, pipe threads and threads in the neck of flanges mutually engage with friction. The friction comes from clean surface to surface engagement, the presence of rust, heat, cold, and the like. During disassembly, rust and corrosion further congeal a neck upon piping making removal a challenge. Pipefitters have turned flanges using various tools, pry bars, claws of hammers, screwdrivers, rebar, other pipe pieces, and other devices placed in the apertures of a flanges. Such tools occupy the apertures imperfectly and while providing some leverage, such tools often slip from the apertures causing the pipefitter to reset them. Such tools provide their leverage upon engaging a nearby portion of the disk that may lead to enlargement or damage to the apertures and the disk. Some pipefitters also utilize strap clamps and for smaller flanges, slip jaw pliers, or channel locks. These two tools grasp the perimeter of the disc and provide leverage so long as the friction between the tool and the disk holds. In time, those tools slip from the round disk.

The present invention overcomes the disadvantages of the prior art and provides a flange tightening tool that utilizes a pair of pins upon a tool that engages apertures upon a flange so that the tool rotates the flange readily without slippage or falling off.

SUMMARY OF THE INVENTION

Generally, the flange tightening tool utilizes a wrench having a fixed jaw integral with a handle and a movable jaw and pins connected to both the fixed jaw and the movable jaw. The pins extend mutually parallel and from the same side of both jaws. The pins generally have a round cylindrical shape with a diameter compatible to a flange aperture. The pins have a connection utilizing a threaded tip that engages a threaded hole in each jaw. The pins are provided in various diameters, often in kit form.

There has thus been outlined, rather broadly, the more important features of the invention in order that the detailed description thereof that follows may be better understood and that the present contribution to the art may be better appreciated. The present invention also includes pins secured using torx bolts, pins welded or otherwise joined to the jaws, pins having different lengths, pins that engage a portion of the teeth of a jaw, pins that avoid engaging the teeth of a jaw, and pins that engage the jaws using a quarter turn slot and pin arrangement. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a flange tightening tool that fits two spaced apart apertures upon a flange.

Another object is to provide such a flange tightening tool that increases the force of the user by at least a factor of two.

Another object is to provide such a flange tightening tool that remains in two of the apertures of a flange without slipping under load.

Another object is to provide such a flange tightening tool that fits two diametrically opposite apertures upon a flange.

Another object is to provide such a flange tightening tool that adjusts to diameters of various flanges.

Another object is to provide such a flange tightening tool that adjusts to diameters of various apertures in flanges.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
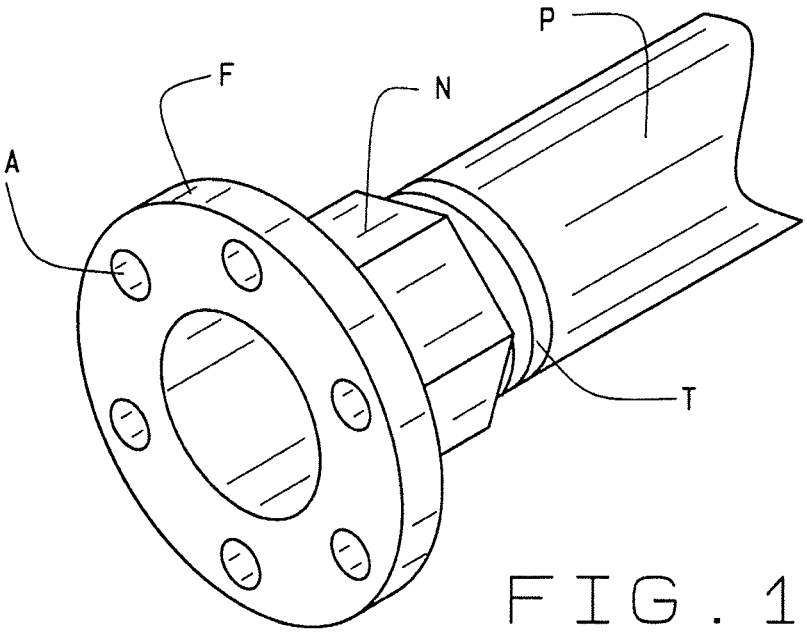
FIG. 1 is a perspective view of a flange upon a pipe.

The present art overcomes the prior art limitations by providing a flange tightening tool. Such a tool generally works with a craftsman on a job with piping as shown in FIG. 1. FIG. 1 shows a perspective view of a pipe P that has an installed flange F upon one end. The flange generally has a round shape and a diameter exceeding the outside diameter of the pipe P. The flange also has a plurality of apertures A regularly spaced about the flange. The apertures usually have a common diameter.

Figure 2:
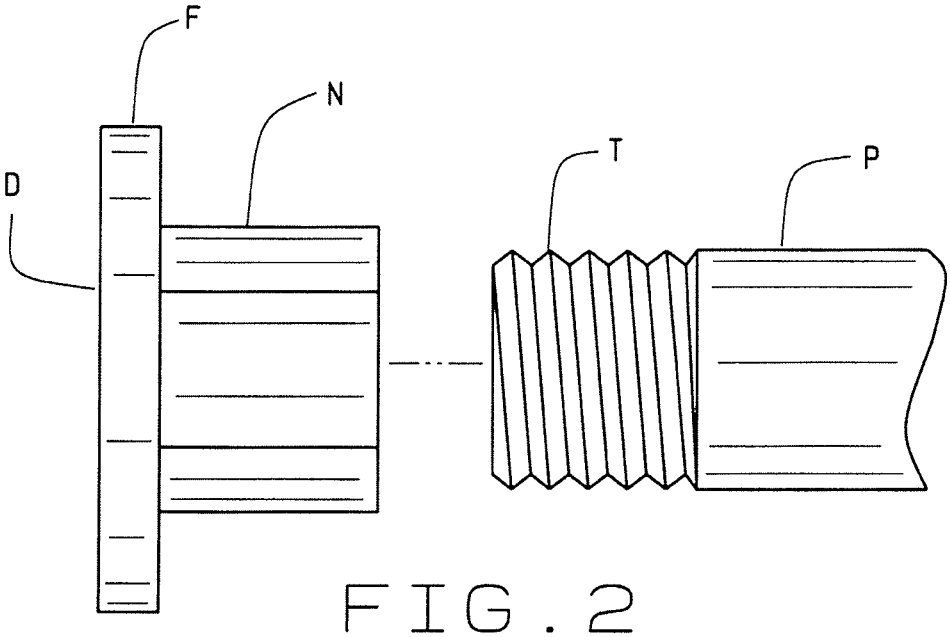
FIG. 2 is a side exploded view of a flange from a pipe.

FIG. 2 describes an existing pipe P and flange F from the side in more detail. The flange F has a disc D, generally the widest part of the flange, and a neck N extending perpendicularly from the center of the disc. The neck has internal threads of a hand and pitch as desired. The neck generally has a height more than the thickness of the disc but a diameter less than the disc's diameter as shown. Across from the neck N in the figure, the pipe P has its end with threading T thereon of a hand and pitch that engages the thread of the neck. Generally the threads T are machine like threads and much less coarse than wood screw threads. The threads T often have a fine pitch that unfortunately attracts rust and corrosion. Attaching or removing a flange F from a pipe P, often calls for significant effort and muscle power by the craftsman and sometimes a jack pipe placed upon the handle of the craftsman's tool. Such a tool may grip the disc or the neck and often slip off either one when under significant load, as from a rusted connection.

Figure 3:
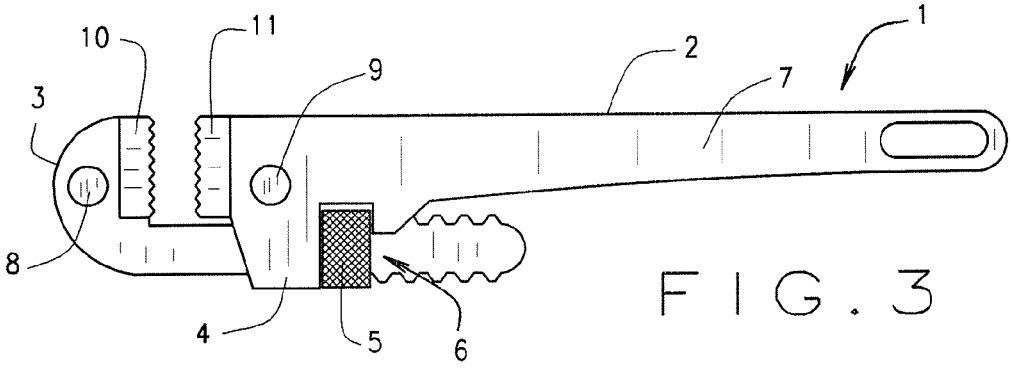
FIG. 3 is a top view of the invention.

As shown, an flange has its apertures A spaced apart. The apertures provide a place of connection for a craftsman's tool. FIG. 3 shows the invention that connects to the apertures to aid a craftsman in rotating a flange F upon a pipe P as described. The invention 1 utilizes a base tool 2 here shown as a wrench. The wrench has two jaws: a movable jaw 3 and a fixed jaw 4. An adjuster 5 admits a stem 6 extending from the movable jaw and into the fixed jaw. The fixed jaw then merges into a handle 7 of lesser width than the fixed jaw. The fixed jaw and the moveable jaw generally have the same width.

In combination with the wrench or other tool as at 2, the invention provides a first pin 8 to the movable jaw and a second pin 9 to the fixed jaw. The pins 8, 9 connect to their respective jaws upon the same side of the wrench and proximate the adjuster but allowing for movement of the adjuster. The pins 8, 9 extend from their jaws outwardly at least beyond the height of the adjuster from the remainder of the wrench. The pins extend a sufficient distance to engage the apertures A of the flange F and to avoid shearing the pins in approximately ninety percent of usage situations. Preferably each pin inserts 0.75 inches into an aperture in a flange. The first pin has a length of approximately 1.75 inches with approximately 0.5 inches having left hand threading, and various diameters while the second pin has a length of approximately 0.5 inches with approximately 0.375 inches having left hand threading, and various diameter.

Figure 4:
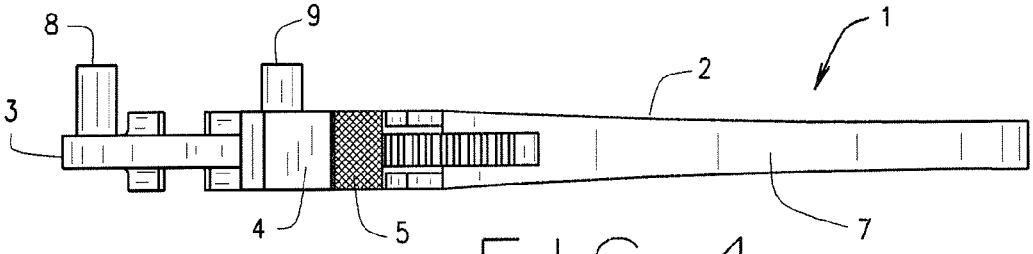
FIG. 4 is a side view of the invention.

Viewing the wrench from the side in FIG. 4 as seen by the user, the invention 1 has the wrench 2 with its handle 7 towards the left. From its end, the handle extends for a length and then widens to the fixed jaw as at 4. The fixed jaw receives the second pin 9 as described above. Spaced slightly away from the fixed jaw, the wrench continues with its adjuster 5, often a cylinder with a knurled exterior and a threaded internal opening. The adjuster receives the stem 3*a* of the movable jaw 3 and adjusts the position of the movable jaw 3 closer or farther from the fixed jaw 4 by rotating the adjuster. The movable jaw 3 then receives the first pin 8 as described above. The first pin has a greater length than the second pin because of the thickness of the fixed jaw. That thickness effectively elevates the second pin compared to the movable jaw. To maintain a similar effective height between the two pins, the first pin's length adds the thickness of the fixed jaw to the second pin's length. Having pins, of the same effective length when installed, allows a user to place the invention flush upon a flange as shown earlier in FIG. 1. The flush invention placement lets the user turn the flange with little risk of damaging it, the pins, the wrench, or the user. In an alternate embodiment, the first pin is much longer than the second pin to account for thickness of the fixed jaw and moreover, to assist the user in placing the invention upon a flange as shown earlier in FIG. 1. The longer first pin allows a user to reach a flange aperture on the far side of a flange such as when the user is in confined quarters or the user has his arm fully extended to reach the flange.

Figure 5:
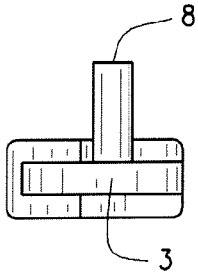
FIG. 5 is a front view of the invention.

Turning to FIG. 5, the invention appears in an end view with the movable jaw 3 towards the foreground. The movable jaw has the first pin 8 installed into it. As the first pin has a greater height than the second pin, the first pin conceals the second pin behind it in this view.

Figure 6:
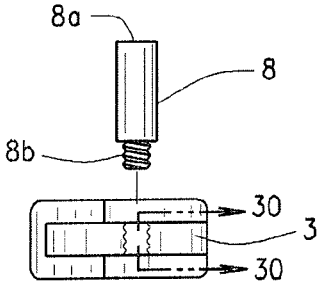
FIG. 6 is an exploded front view of the invention.

From time to time, a flange may have apertures of a different diameter than expected. The invention allows for a craftsman to change the first pin 8 and the second pin 9. FIG. 6 shows an end view of the invention from the movable jaw 3 but with the first pin 8 separated from and above the movable jaw. The first pin 8 here shown, and the second pin 9 as well, have a generally cylindrical form of a desired diameter. The first pin has two opposite ends, a first end 8*a* that engages an aperture on a flange, and a second end, or tip 8*b*, that secures to the movable jaw 3. The tip is generally left hand threaded so that the first pin remains in place during right handed turning of the invention during use. The tip cooperatively engages a threaded opening in the movable jaw, not shown. Though the preceding paragraph has referred to the first pin and movable jaw, the description also applies respectively to the second pin and the fixed jaw.

Figure 7A:
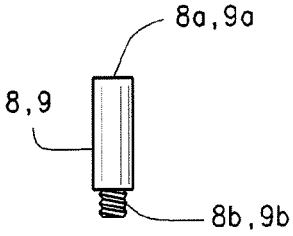
FIG. 7 is a side view of alternate embodiments of the pin of the invention.
Figure 7B:
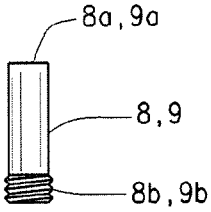

Securing a pin to a jaw may occur in various forms. FIGS. 7*a*, 7*b* show two mechanical methods for such securing. FIG. 7*a* shows a side view of a pin, here the first pin 8, the first pin has its first end 8*a*, here shown as slightly rounded. The rounding assists the craftsman in placing the first end into a flange's aperture. On the other end of the pin, or second end, the tip 8*b* has its threads, generally left handed, of a lesser diameter than the remainder of the pin. With this sizing of the tip, a craftsman turns the pin into the jaw until the pin abuts the surface of the jaw. Alternatively in FIG. 7*b*, the tip 8*b* has threads upon the second end. These threads though have the same diameter as the remainder of the pin. Here, a craftsman turns the pin, second end first, into a cooperating opening in the jaw until the pin fails to turn further. Showing a whole pin in FIGS. 6, 7*a*, 7*b*, the first pin 8 has a length of approximately 2.55 inches from first end to second end and the second pin 9 has a length of approximately 2.50 inches from first end to second end. Though this description refers to the first pin 8 and its features, it also applies to the second pin 9, its first end 9*a*, and its second end 9*b*.

In an alternate embodiment, the first pin connects to an arm and the second pin connects to a shoulder. The arm then adjustably connects to the shoulder. The arm then extends inwardly and outwardly from the shoulder. For additional leverage, a handle joins to the shoulder.

Figure 8:
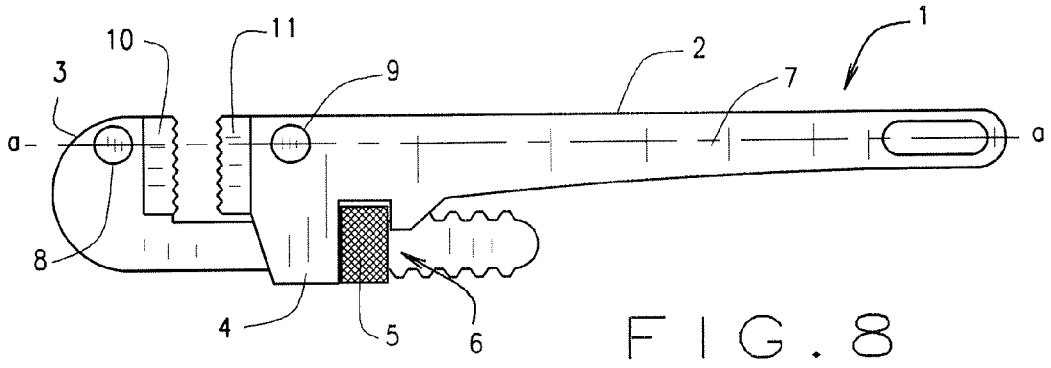
FIG. 8 is a top view of an alternate embodiment of the invention.

FIG. 8 shows an alternate embodiment of the invention based upon FIG. 3. As above, the invention connects to the apertures to aid a craftsman in rotating a flange F upon a pipe P. The invention 1 utilizes a base tool 2 here shown as a wrench. The wrench has two jaws: a movable jaw 3 and a fixed jaw 4. An adjuster 5 admits a stem 6 extending from the movable jaw and into the fixed jaw. The fixed jaw then merges into a handle 7 of lesser width than the fixed jaw. The fixed jaw and the moveable jaw generally have the same width. The movable jaw has a teeth 10 of hardened steel joined to it. The fixed jaw also has opposite teeth 11 of hardened steel joined to it and arranged opposite the teeth 10 of the moveable jaw. In combination with the wrench, or other tool as at 2, the invention provides a first pin 8 to the movable jaw and a second pin 9 to the fixed jaw. The pins 8, 9 connect to their respective jaws upon the same side of the wrench and proximate the adjuster but allowing for movement of the adjuster. The pins 8, 9 extend from their jaws outwardly at least beyond the height of the adjuster from the remainder of the wrench. In this alternate embodiment, the wrench has a centerline as at a-a that extends for its length. The first pin 8 and the second pin 9 have their centers along the centerline as shown. Also, the first pin 8 does not penetrate the teeth 10 and the second pin 9 does not penetrate the counterpart teeth 11. The first pin and the second pin threadily engage holes in their respective jaws.

Figure 9:
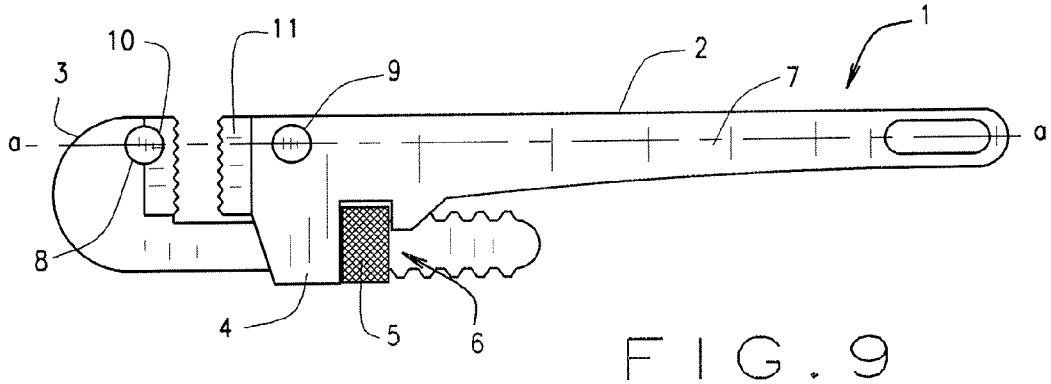
FIG. 9 is a top view of a further alternate embodiment of the invention.

Similar to FIG. 8, FIG. 9 shows a wrench 2 with its fixed jaw and moveable jaw generally of the same width. The movable jaw has teeth 10 of hardened steel joined to it and does the fixed jaw have teeth 11 and arranged opposite the teeth 10 as shown. The first pin 8 joins to the movable jaw and a second pin 9 to the fixed jaw. The pins 8, 9 connect to their respective jaws upon the same side of the wrench and proximate the adjuster but allowing for movement of the adjuster. The pins 8, 9 extend from their jaws outwardly at least beyond the height of the adjuster from the remainder of the wrench. In this alternate embodiment, the wrench has a centerline as at a-a that extends for its length. The first pin 8 and the second pin 9 have their centers along the centerline as shown. But in this alternate embodiment, the first pin 8 partially penetrates the teeth 10 as it joins to the movable jaw while the second pin 9 does not penetrate the counterpart teeth 11. The first pin and the second pin threadily engage holes in their respective jaws.

Figure 10:
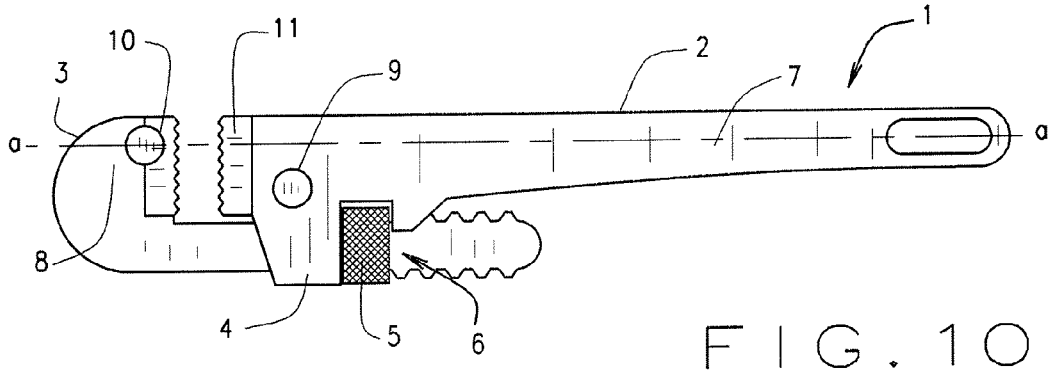
FIG. 10 is a top view of a further alternate embodiment of the invention.

Separating from FIG. 9, FIG. 10 once more has a wrench 2 with its fixed jaw and moveable jaw generally of the same width. The movable jaw has teeth 10 of hardened steel joined to it as does the fixed jaw have teeth 11 as shown. The first pin 8 joins to the movable jaw and a second pin 9 to the fixed jaw. The pins 8, 9 connect to their respective jaws upon the same side of the wrench. The pins 8, 9 extend from their jaws outwardly at least beyond the height of the adjuster from the remainder of the wrench. In this alternate embodiment, the wrench has a centerline as at a-a that extends for its length. The first pin 8 has its center along the centerline as shown. But in this alternate embodiment, the second pin 9 has its center below the centerline a-a, that is, closer towards the adjuster 5, or alternatively away from the opening of the jaws. The first pin 8 partially penetrates the teeth 10 as it joins to the movable jaw while the second pin 9 does not penetrate the counterpart teeth 11. The first pin and the second pin threadily engage holes in their respective jaws.

Figure 11:
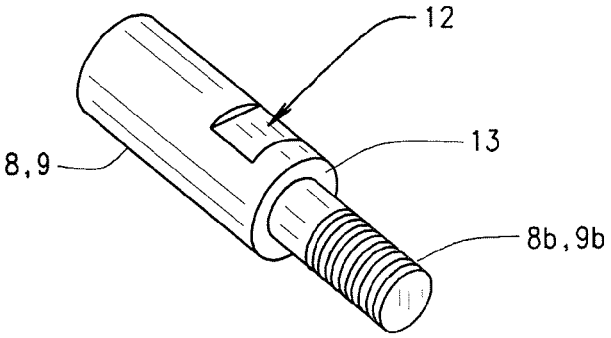
FIG. 11 is a perspective view of a pin for an eighteen inch long embodiment of the invention.

The present invention works upon wrenches and other tools of various lengths. FIG. 11 shows a perspective view of a pin 8, 9 for an eighteen inch long wrench. For this particular length of wrench, the pins 8, 9 are provided of similar length so the description proceeds in reference to both the first pin 8 and the second pin 9, hereinafter pins. The pins have a generally cylindrical form of a working diameter to engage an aperture of a flange and then a stepped diameter to threadily engage the threaded holes upon the wrench for installation. This figures shows the cylindrical form having a slot 12 therein slightly away from a step 13 from the working diameter to the stepped diameter of the tip 8*b*, 9*b*. The tip 8*b*, 9*b* has left hand threading, typically ⅜-16. The threading extends for approximately 0.74 inches and the tip itself extends for approximately one inch outwardly from the step 13.

Figure 12:
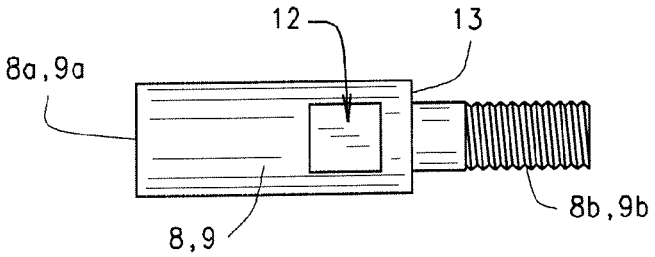
FIG. 12 is a top view of the pin of FIG. 11.
Figure 13:
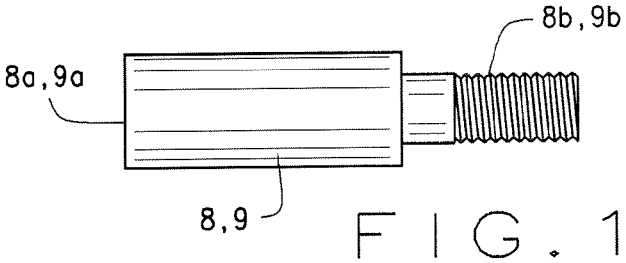
FIG. 13 is a bottom view of the pin of FIG. 11.

FIG. 12 shows a top view of this alternate embodiment of the pins. This view shows the slot 12 of a generally rectangular shape suitable for receiving one jaw of another wrench for installing the pin. The slot is closer to the step 13 than the first end 8*a*, 9*a*. The slot is discontinuous and does not extend around the entire perimeter of the cylindrical form. FIG. 13 shows the cylindrical form away form the slot and generally the pin has its working diameter and then the stepped diameter leading to the tip.

Figure 14:
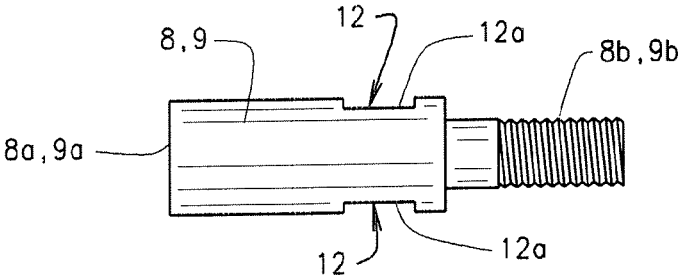
FIG. 14 is a side view of the pin of FIG. 11.

FIG. 14 provides a side view of this embodiment and shows two slots 12. The two slots 12 have an opposite arrangement so that their flat surfaces 12*a* as shown have a mutually parallel orientation. The flat surface and the two slots receive both jaws of another wrench for assisting the installation of this pin into wrench 2. The tip has its length of approximately one inch and threading for approximately 0.75 inches. The slots have a width of approximately 0.375 inches and a spacing from the step of approximately 0.18 inches. The slots are mutually spaced apart by approximately 0.50 inches. Outwardly from the step the remainder of the pin is approximately one inch long. The overall length of this embodiment is approximately 2.5 inches.

Figure 15:
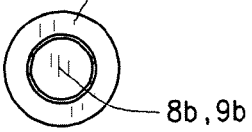
FIG. 15 is a front view of the pin of FIG. 11.
Figure 16:
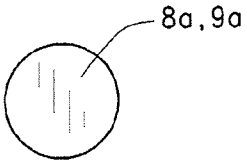
FIG. 16 is a rear view of the pin of FIG. 11.

FIG. 15 illustrates a front view of the tip 8*b*, 9*b* of this alternate embodiment. The tip has a lesser diameter than the working diameter of the remainder of the pin. The tip has an approximate diameter of 0.375 inches and the working diameter of the pin is approximately 0.625 inches. FIG. 16 has a rear view of the working diameter of the pins, generally shown as a flat circular shape as at 8*a*, 9*a*. This view shows the portion of the pins that enters an aperture of a flange.

Figure 17:
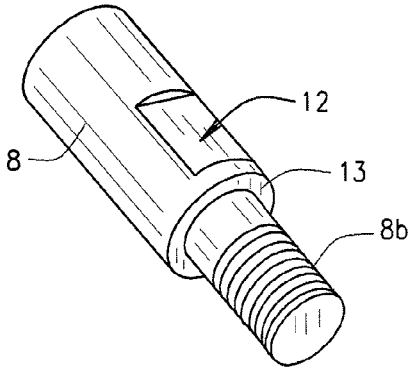
FIG. 17 is a perspective view of a first pin for a twenty four long embodiment of the invention.

But tools come in other lengths as FIG. 17 shows a perspective view of a pin 8 for a twenty four inch long wrench embodiment of the invention. For this particular length of wrench, the pins are provided of different lengths. The first pin has its generally cylindrical form of a working diameter to engage an aperture of a flange and then a stepped diameter to threadily engage the threaded holes upon the wrench for installation. This figure shows the cylindrical form having a slot 12 therein slightly away from a step 13 from the working diameter to the stepped diameter of the tip 8*b* with its left hand threading, typically ½-13. The threading extends for approximately 0.76 inches and the tip itself extends for approximately one inch outwardly from the step 13.

Figure 18:
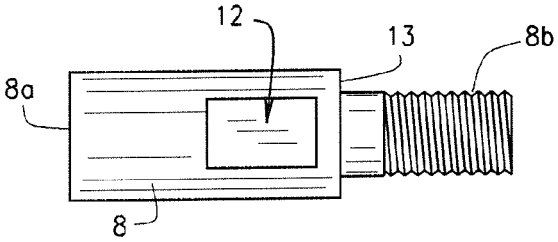
FIG. 18 is a top view of the pin of FIG. 17.
Figure 19:
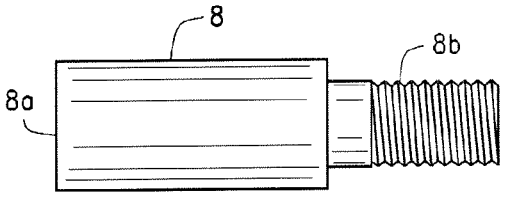
FIG. 19 is a bottom view of the pin of FIG. 17.

FIG. 18 shows a top view of this alternate embodiment of the first pin with the slot 12 of a generally rectangular shape suitable for receiving one jaw of another wrench for installing the pin. The slot is closer to the step 13 than the first end 8*a*. The slot is discontinuous and does not extend around the entire perimeter of the cylindrical form. FIG. 19 shows the cylindrical form away form the slot and generally the pin has its working diameter and then the stepped diameter leading to the tip.

Figure 20:
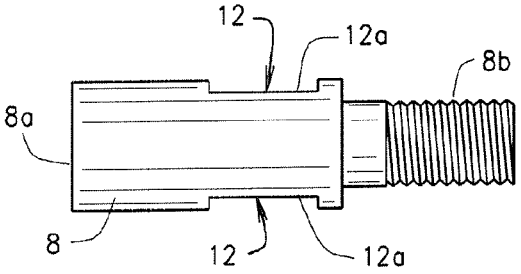
FIG. 20 is a side view of the pin of FIG. 17.

FIG. 20 provides a side view of this embodiment and shows two opposite slots 12 with their flat surfaces 12*a* being mutually parallel. The flat surface and the two slots receive both jaws of another wrench for installation of this pin into wrench 2. The tip has its length of approximately one inch and threading for approximately 0.76 inches. The slots have a width of approximately 0.650 inches and a spacing from the step of approximately 0.125 inches. The slots are mutually spaced apart by approximately 0.620 inches. Outwardly from the step the remainder of the pin is approximately 0.786 inch long. The overall length of this embodiment is approximately 2.55 inches.

Figure 21:
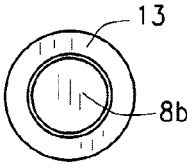
FIG. 21 is a front view of the pin of FIG. 17.
Figure 22:
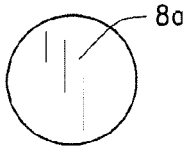
FIG. 22 is a rear view of the pin of FIG. 17.

FIG. 21 illustrates a front view of the tip 8*b* of this alternate embodiment. The tip has a lesser diameter than the working diameter of the remainder of the pin. The tip has an approximate diameter of 0.500 inches and the working diameter of the pin is approximately 0.750 inches. FIG. 22 then has the rear view of the working diameter of the first pin, generally shown as a flat circular shape as at 8*a* so that the pin enters an aperture of a flange.

Figure 23:
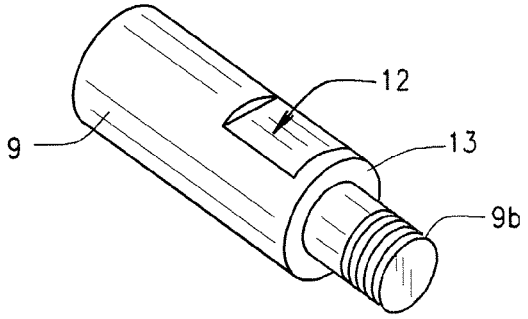
FIG. 23 is a perspective view of a second pin for a twenty four long embodiment of the invention.

This embodiment of the invention for a twenty four inch long wrench has the second pin 9 shown in FIG. 23 as a perspective view. The second pin also has its generally cylindrical form of a working diameter to engage an aperture of a flange and then a stepped diameter to threadily engage the threaded holes upon the wrench for installation. This figure has a cylindrical form like before and having a slot 12 therein slightly away from a step 13 from the working diameter to the stepped diameter of the tip 8*b* with its left hand threading, typically ½-13. The threading extends for approximately 0.375 inches and the tip itself extends for approximately 0.625 inches outwardly from the step 13.

Figure 24:
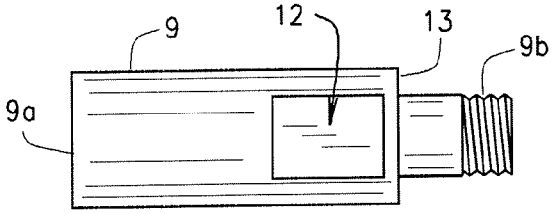
FIG. 24 is a top view of the pin of FIG. 23.
Figure 25:
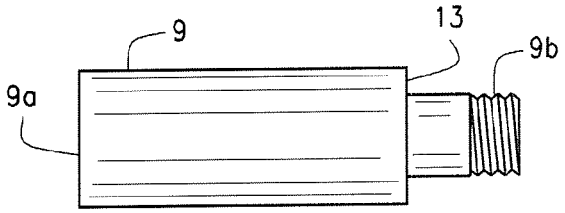
FIG. 25 is a bottom view of the pin of FIG. 23.

FIG. 24 provides a top view of this alternate embodiment of the second pin with the slot 12 of a generally rectangular shape suitable for receiving one jaw of another wrench for installing the pin. The slot is closer to the step 13 than the first end 9*a*. The slot is discontinuous, that is, it wrap around the entire perimeter of the cylindrical form. FIG. 25 shows the cylindrical form away form the slot and generally the pin has its working diameter and then the stepped diameter leading to the tip.

Figure 26:
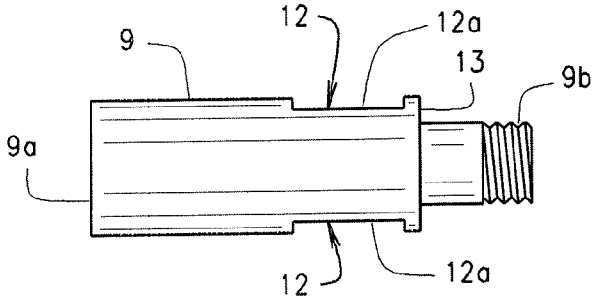
FIG. 26 is a side view of the pin of FIG. 23.

FIG. 26 provides a side view of this embodiment and shows two opposite slots 12 with their flat surfaces 12*a* being mutually parallel. The flat surface and the two slots receive of another wrench for installation of this pin into wrench 2. The tip has its length of approximately one inch and threading for approximately 0.625 inches. The slots have a width of approximately 0.620 inches and a spacing from the step of approximately 0.125 inches. The slots are mutually spaced apart by approximately 0.620 inches. Outwardly from the step the remainder of the pin is approximately 1.130 inches long. The overall length of this embodiment is approximately 2.50 inches.

Figure 27:
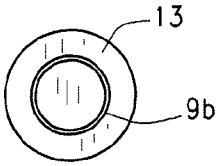
FIG. 27 is a front view of the pin of FIG. 23.
Figure 28:
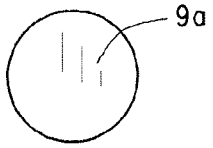
FIG. 28 is a rear view of the pin of FIG. 23.

FIG. 27 illustrates a front view of the tip 9*b* of this alternate embodiment with its tip of lesser diameter than the working diameter of the rest of the pin. The tip has an approximate diameter of 0.500 inches and the working diameter of the pin is approximately 0.750 inches. FIG. 28 then has the rear view of the working diameter of the second pin, generally a flat circular shape as at 9*a* so that the pin enters an aperture of a flange. The preceding figures have shown first pins and second pins with left hand threading upon their tips. The threading has its length along the tip, or second end, and the second end has its width, or diameter. The length of threading on the second end has a ratio to the width of the second end of at least 0.25.

Figure 29:
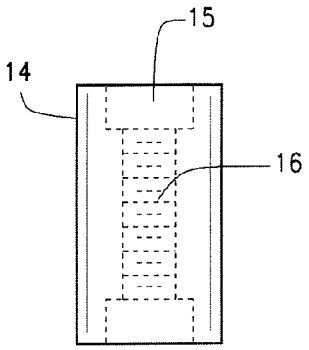
FIG. 29 is a side view of a bushing for an alternate embodiment of the invention.

FIG. 29 then provides a side view of a bushing 14 used for an alternate installation of holes in the wrench 2. The busing has a generally cylindrical form with a hollow interior formed by a first throat 15 of a first diameter and then a second throat 16 inwardly for the first throat 15. The second throat has a second diameter less than that of the first diameter. The second throat generally has threading to accept the tips 8*b*, 9*b* of pins threadily engaging it. The second throat is generally centered between two first throats and the second throat has a length greater than a first throat.

The bushing merges into a hole in a jaw using press fitting, welding, or other connecting means.

Figure 30:
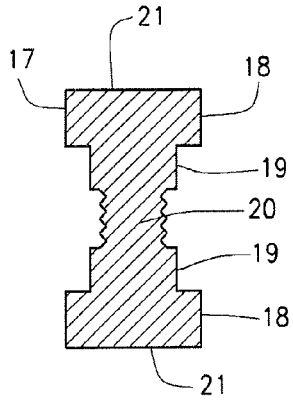
FIG. 30 is a section view through a jaw of the wrench of the invention; and, FIG. 31 is a graph of load carrying capacity and deflection of two embodiments of the invention.

FIG. 30 then shows a sectional view through a hole 17 in a jaw as previously shown in FIGS. 3, 6, 8, 9, 10. The fixed jaw 4 and the movable jaw 3 both have holes to receive pins 9, 8 respectively. Each jaw undergoes machining to receive its threaded aperture 17. Each aperture has two opposite openings 21 that admit a tip 8*b*, 9*b* of a pin. The openings lead to a first throat 18 of a first diameter which lead to a second throat 19 of its second diameter, and which leads to a third throat 20 of its third diameter. The third throat has a location between two second throats and each second throat has an adjacent first throat with all throats being concentric. The first diameter exceeds the second diameter which exceeds the third diameter. The throats combine to provide the aperture with a bar bell like shaped cross section as shown. The third throat includes threading to receive the tips 8*b*, 9*b* of pins, preferably left hand threading.

Figure 31:
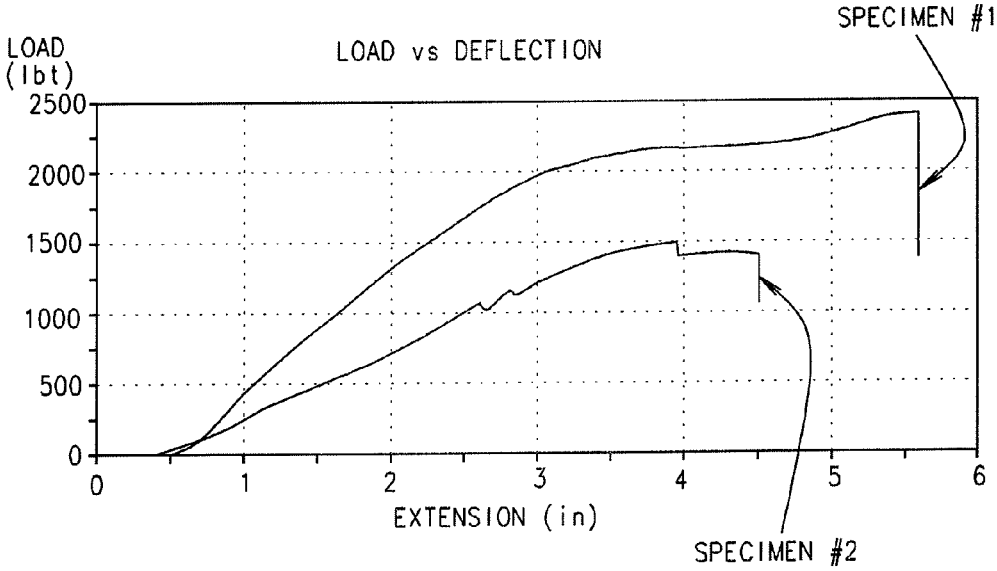

AND, FIG. 31 shows a graph of an eighteen inch wrench and a twenty four inch wrench equipped with pins as described above that underwent load to failure testing. The graph plots the load applied to the wrenches then their pin and the resulting deflection typically at the end of the handle of the wrench 2. The twenty four inch wrench survived up to 2373 lb. while the eighteen inch wrench withstood up to 1465 lb. The longer wrench deflected further than the shorter wrench. The graph was produced from test results at the St. Louis Testing Laboratories of St. Louis, Mo. The present invention and its components, particularly the pins and the apertures resist at least 1500 foot pounds of torque applied to them.

From the aforementioned description, a flange tightening tool has been described. The a flange tightening tool is uniquely capable of linking to a flange by inserting pins into apertures upon the flange and then allowing a craftsman to turn the flange upon a pipe. The flange tightening tool and its various components may be may be manufactured from many materials, including but not limited to, steel, aluminum, polymers, ferrous and non-ferrous metal foils, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A device to rotate an object having apertures therein, comprising:

a wrench having a movable jaw, a fixed jaw, an elongated handle with a longitudinal axis, a side generally coplanar with the longitudinal axis, said fixed jaw integral with said elongated handle, and said movable jaw cooperating with said fixed jaw;

a threaded aperture into said movable jaw;

a threaded aperture into said fixed jaw parallel to said threaded aperture of said movable jaw;

a first round pin threadily engaging said threaded aperture into said movable jaw;

a second round pin threadily engaging said threaded aperture into said fixed jaw; and, said first pin and said second pin both having a position upon said side, said first pin and said second pin both extending for a same distance from said side when installed in said movable jaw and said fixed jaw respectively;

wherein said first pin and said second pin remain fixed in mutually spacing in their respective jaws unless said movable jaw is adapted to move relative to said fixed jaw;

wherein said first pin and said second pin remain mutually spaced apart when said handle is adapted to move the object clockwise and counterclockwise.

2. The object rotating device of claim 1 further comprising:

said first pin having a flat first end and an opposite second end, said second end engaging said movable jaw; and, said second pin having a flat first end and an opposite second end, said second end engaging said fixed jaw.

3. The object rotating device of claim 2 further comprising:

said second end of said first pin having a width less than the remainder of said first pin; and, said second end of said second pin having a width less than the remainder of said second pin.

4. The object rotating device of claim 2 further comprising:

said first pin having a diameter and said second end having left hand threading, said left hand threading extending along said second end, and wherein the ratio of said left hand threading along said second end to said diameter of said second end is at least 0.25; and, said second pin having a diameter and said second end having left hand threading, said left hand threading extending along said second end, and wherein the ratio of said left hand threading along said second end to said diameter of said second end is at least 0.25.

5. A device to rotate an object having apertures therein, said device including a wrench with a movable jaw, a fixed jaw, an elongated handle with a longitudinal axis, a side generally coplanar with the longitudinal axis, a centerline generally through said elongated handle and parallel to the longitudinal axis, the fixed jaw integrating with the elongated handle and the movable jaw cooperating with the fixed jaw, wherein the improvement comprises:

a threaded aperture into said movable jaw;

a threaded aperture into said fixed jaw parallel to said threaded aperture of said movable jaw;

a round steel first pin connecting to said threaded aperture into said movable jaw;

a round steel second pin connecting to said threaded aperture into said fixed jaw;

said first pin and said second pin being upon the centerline;

said first pin having a first end and an opposite second end, said second end threadily engaging said movable jaw, and said first end adapted to engage apertures of an object; and, said second pin having a first end and an opposite second end, said second end threadily engaging said fixed jaw and said first end adapted to engage apertures of an object.

6. The object rotating device of claim 5 further comprising:

said first pin having a flat first end and an opposite second end, said second end engaging said movable jaw and having a width less than the remainder of said first pin; and, said second pin having a flat first end and an opposite second end, said second end engaging said fixed jaw and having a width less than the remainder of said second pin.

7. The object rotating device of claim 6 wherein said first pin, said second pin, said threaded aperture in the movable jaw, and said threaded aperture in the fixed jaw resist at least 1500 foot pounds of torque.

8. A device to rotate flanges upon pipes, comprising:

a first pin and a second pin, said first pin and said second pin being mutually parallel and spaced apart;

a stem connecting to said first pin;

a shoulder connecting to said second pin, said shoulder receiving said stem;

said stem telescoping from said shoulder;

said first pin and said second pin attaining a same distance from said stem and said shoulder respectively;

said device having an elongated handle with a longitudinal axis, a side generally coplanar with the longitudinal axis, a centerline generally through said elongated handle and parallel to the longitudinal axis; and, said shoulder being integral with said handle.

9. The device to rotate flanges upon pipes of claim 8 further comprising:

said first pin having a flat first end and an opposite second end, said second end threadily engaging said stem and having a width less than the remainder of said first pin, said second pin having a flat first end and an opposite second end, said second end engaging said shoulder and having a width less than the remainder of said first pin.

10. The device to rotate flanges upon pipes of claim 8 further comprising:

said first pin having a diameter and said second end having left hand threading extending along said second end for a length, and wherein the ratio of the length of said left hand threading to said diameter is at least 0.25; and, said second pin having a diameter and said second end having left hand threading extending along said second end for a length, and wherein the ratio of the length of said left hand threading to said diameter is at least 0.25.

* * * * *